United States Patent [19]

Palm

[11] 4,241,916

[45] Dec. 30, 1980

[54] NO-TIE SPORTS GOALS

[76] Inventor: Robert J. Palm, 1740 E. Brookdale, LaHabra, Calif. 90631

[21] Appl. No.: 90,006

[22] Filed: Oct. 31, 1979

[51] Int. Cl.[3] ..... A63B 63/00; A63B 63/08

[52] U.S. Cl. ..... 273/1.5 R; 273/73 D; 273/127 B; 273/400; 273/411; 24/115 K; 24/131 R

[58] Field of Search ..... 273/1.5, 73 D, 398, 273/402, 411, 127; 114/218; 24/115 G, 115 H, 115 J, 115 K, 121, 122, 129 B, 129 C, 131 R, 144–146

[56] References Cited

U.S. PATENT DOCUMENTS

| | | | |
|---|---|---|---|
| 477,939 | 6/1892 | Hubbell | 24/129 C X |
| 743,627 | 11/1903 | Edgerton | 24/146 |
| 774,719 | 11/1904 | Estes | 24/146 |
| 2,053,635 | 9/1936 | Sandeberg | 273/1.5 R |
| 2,666,641 | 1/1954 | Bonham | 24/131 R X |
| 2,884,249 | 4/1959 | Cunningham | 273/1.5 R |
| 3,595,573 | 7/1971 | Kilbourne | 273/1.5 R |

FOREIGN PATENT DOCUMENTS

| | | | |
|---|---|---|---|
| 46491 | 5/1887 | Fed. Rep. of Germany | 24/146 |
| 143978 | 9/1903 | Fed. Rep. of Germany | 24/145 |
| 318791 | 2/1920 | Fed. Rep. of Germany | 24/146 |

*Primary Examiner*—Paul E. Shapiro
*Attorney, Agent, or Firm*—Robert K. Wallor

[57] ABSTRACT

Sports goals employing a goal net having a plurality of cord loop portions comprising the boundary region of such goal net whereat attachment to a goal frame is made by passing each of said cord loops, respectively, through one of a plurality of spaced apart fasteners on the goal frame. Said fasteners are configured as a bracket member which is attached at its midpoint to the goal frame, substantially in the plane thereof, and which has both ends formed, by bending, into a nearly circular path to accept the goal net cord loops. The extremities of the loop accepting regions are designed to be spring-tight against the goal frame, thereby precluding the goal net from being readily removed. An alternate configuration is envisioned to include only one cord accepting region per fastener.

5 Claims, 7 Drawing Figures

NO-TIE SPORTS GOALS

BACKGROUND OF THE INVENTION

The present invention relates to the art of sports goals, such as basketball hoops or goals, and more particularly to the means for attaching the goal net to the frame or ring.

There is contained in the prior art various forms of attaching the net of a basketball goal to the ring provide therefor. Examples of these types of prior art constructions are illustrated in U.S. Pat. Nos. 2,666,641; 2,735,680; 2,884,249, and 4,071,238. I have discovered that in each of these the advantages of ease of assembly and removal of the net from the goal frame are cited. However, I have been led by experience to the further discovery that, in certain applications, a distinct advantage exists in having the goal net non-removably attached to the goal frame, to prohibit criminal removal of the goal net in a reuseable manner.

With regard to the specific application of the present invention to basketball hoops or goals, I have futher discovered that existing goal net tie means, while serving their intended purpose, often become bent from contact with the ball from below the hoop, or from players' hands driving play, thereby weakening such ties and increasing the likelihood that they may be broken from the goal ring. Further, such present goal net tie means may present a hazard to players because of their physical size and/or configuration. Both such situations are relieved by the present invention, in that the small size of the present "no-ties" is such as to limit the surface area for bending moments from ball or hand contact, and similarly, significantly reduce the hazards to players. These advantages are especially true when the present "no-ties" are employed with a specially configured goal frame having recessed or flatted areas for attachment of the "no-ties".

The further advantages and distinction of my invention over the prior art will become more clearly evident as the disclosure proceeds.

SUMMARY OF THE INVENTION

The nature of the invention herein described concerns the interrelationships and configurations of the combination of a sports goal net, having a plurality of cord loop portions, fabricated of rope or other types of material, a goal frame member, having one surface devoted to attachment of the goal net, and a plurality of hook or "no-tie" elements spaced apart on and rigidly affixed to the goal frame member, such that each accepts one of the cord loop portions of the goal net.

Present day goal nets, particularly those utilized in sports such as basketball, soccer, water polo, lacrosse, or hockey, are commonly made of cotton or nylon cord knotted in open mesh form, with the size of the mesh being based on the particular sport. Such a net is hung from, or suspended between portions of, a goal frame of rigid, durable material.

Prior means of attaching the goal net to the goal frame included tying loose ends of the goal net mesh to the frame, and more recently by "no-tie" or hook means, around which loops of the cord goal net mesh are looped to hold the goal net in place.

In the present invention, a plurality of specially configured no-tie members, are rigidly affixed to the goal frame, spaced apart equally such that the goal net is appropriately attached to the goal frame. Each such no-tie member is configured, in cross section forming a plane parallel to the longitudinal extent of the goal frame, such that an incomplete eye loop is formed at each extremity of the "no-tie" member. The central portion of each "no-tie" member abuts the goal frame member and is held there by rigid attachment means. Each incomplete eye loop depends from the central portion of the "no-tie" beginning in a direction normal to and away from the goal frame member and proceeding then in a circular path outwardly from the central portion until the loop approaches a tangential contact with the goal frame member. The radius of curvature of such circular cross-section portion is slightly larger than that necessary for exact tangential contact in order that the tip of the "no-tie" shall remain in contact with the goal frame member, except when the cord loop of the goal net is passed through from the exterior to a position within the eye loop. The tension of contact is such that the cord net loop cannot readily be again passed from within the eye loop to the exterior, thereby precluding removal of the goal net from the goal frame without cutting the cord loops.

BRIEF DESCRIPTION OF THE DRAWINGS

Although the characteristic features of this invention will be particularly pointed out in the claims, the invention itself,and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE PRINCIPAL EMBODIMENT

Figure 1:
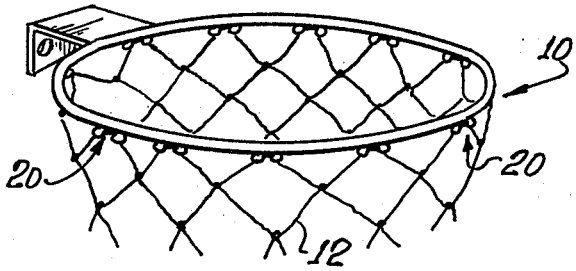
FIG. 1 is a fragmentary perspective view of a basketball goal frame and goal net assembly including the present "no-tie" net attaching means.

Referring now to FIG. 1, there is illustrated a basketball goal assembly comprised of a goal ring 10 which is rigidly attached to a supporting bracket (reference), and a goal net 12 consisting of a cord mesh. Said goal ring 10, in the case of a basketball goal, is configured from a circular ring of rigid material, typically having a circular cross-section.

Figure 2:
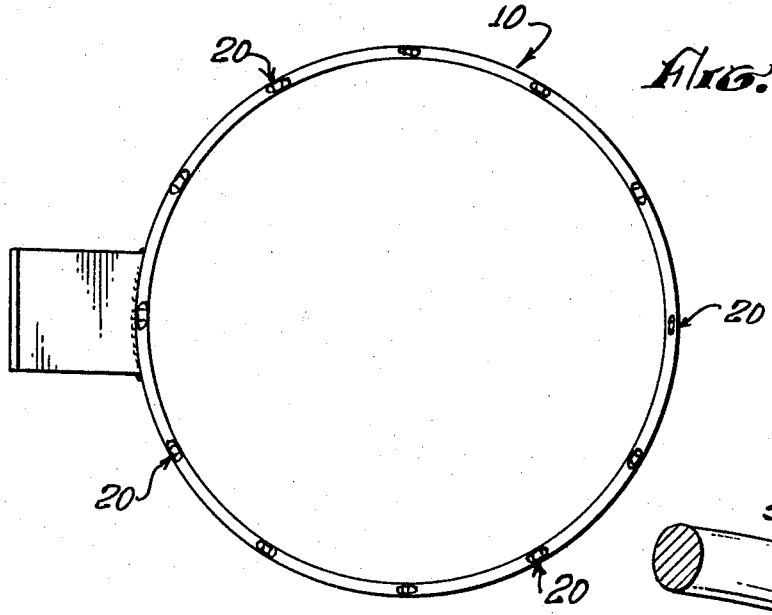
FIG. 2 is a bottom plan view of a typical basketball goal frame member, showing the plurality of no-tie net attaching means.

Referring now to FIG. 2, the lower view of a basketball goal ring 10 is illustrated to show the typical placement of the present "no-tie" net attaching members 20, of which two such are identified numerically. For other applications, the configuration of the goal frame member would be appropriate to the designated sport, however, a plurality of "no-tie" net attaching members would be spaced along the extent of such goal frame member to accept the appropriate plurality of cord loops from the goal net of the sport.

Figure 4:
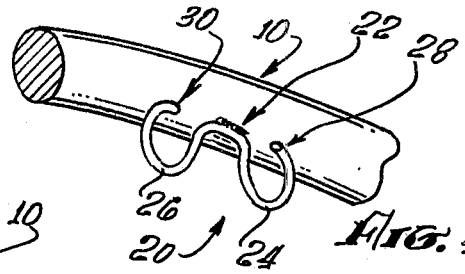
FIG. 4 is a detail fragmentary view of a goal frame member, illustrating in detail the configuration of the principal embodiment of the present "no-tie" net attaching means.

Referring now to FIG. 4, illustrating therein the principal embodiment of the "no-tie" net attaching member 20, it can be observed that said "no-tie" net attaching member 20 is rigidly attached in its central region 22 to the surface of the goal ring 10. Said "no-tie" net attaching member 20 is unitarily formed of rigid material having a generally circular cross-section, said rigid material having a resilient nature such that it will flex under stress but will resume its configuration when stress is relaxed.

The configuration of the "no-tie" net attaching member 20 as illustrated, contains a central region 22, and two partial eye loop regions 24, 26 formed by bending the member downward from the central region 22 and then bending the member, progressively toward its extremities 28, 30, in a plane through the axis of the member, in a generally circular path to form the partial eye loop regions 24, 26. The extremities 28, 30, of said "no-tie" net attaching member 20 are directed back toward the said central region 22 and are in tension contact with the goal frame 10.

Figure 5:
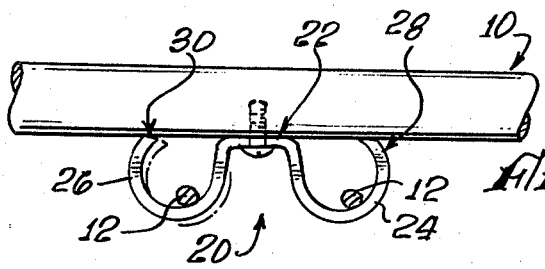
FIG. 5 is a side elevational view of a portion of a goal frame member, showing a "no-tie" net attaching member, and showing in "ghost" presentation the motion of one eye loop thereof during the passage of the cord loop of a goal net from the exterior to the interior area of said eye loop.

Referring now to FIG. 5, illustrating, in elevation, the attachment of the "no-tie" net attaching member 20 to the goal frame 10, the central region 22 of the "no-tie" net attaching member 20, is shown to be affixed to the goal frame 10 by rivet or screw means. Within the partial eye loop regions 24, 26, a cross-section of the cord loop of the goal net 12 is shown for reference. In installing the goal net 12 into the eye loop region 26, the cord loop is passed across the extremity 30, thereby forcing the eye loop 26 to assume the ghost position indicated in FIG. 5. After the goal net 12 has passed over extremity 30 and into the eye loop region 26, said eye loop region 26 and extremity 30 resume their original positions, thereby locking the goal net 12 within the eye loop 26. A similar series of events transpires in installing the goal net 12 into the eye loop region 24 over extremity 28.

Once the goal net is installed as described hereinabove, it cannot readily be removed without cutting the cord loops.

The relative sizes of the eye loop regions 24, 26 are such that they approximate but exceed the diameter of the cord of the goal net 12.

DESCRIPTION OF ALTERNATE EMBODIMENTS

Figure 3:
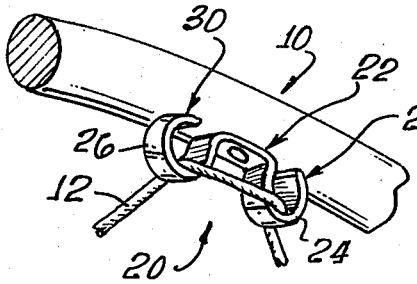
FIG. 3 is a detail fragmentary view of a goal frame member, illustrating in detail the configuration of one embodiment of the present "no-tie" net attaching means.

Referring now to FIG. 3, as an alternate embodiment of the "no-tie" net attaching member 20, consisting of a central region 22, a loop eye regions 24, 26, and extremities 28, 30 is fabricated of a single member having a rectangular cross-section wherein the bends that form the several described regions of the "no-tie" net attaching member are such that a cross-section through the longitudinal axis of said member would contain the short dimension of said rectangle.

Figure 6:
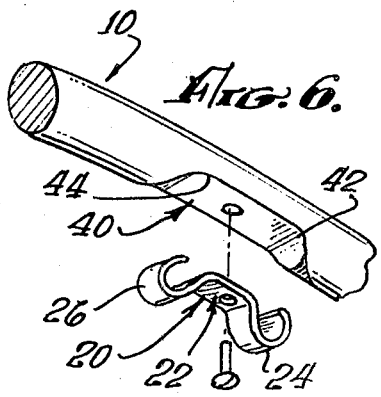
FIG. 6 is an exploded detail fragmentary view of a goal frame member specially configured with a recessed or flatted area to receive the "no-tie" net attaching member.

As a further alternate embodiment, referring now to FIG. 6, it is envisioned that the safety and durability of the goal assembly described herein would be enhanced by specially forming the goal frame 10 in the region where at the "no-tie" net attaching members are situated. Said special forming would be comprised of bevelling or forming a flatted region 40 of sufficient dimension to accept the "no-tie" net attaching member 20 said flatted region 40 is blended into the nominal shape and dimension of the goal frame 10 by regions 42 and 44, which extend the flatted region providing space for the goal net cord to pass into the eye loop regions.

Figure 7:
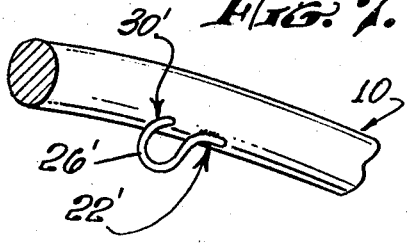
FIG. 7 is a fragmentary view of an alternate embodiment wherein the "no-tie" net attaching member consists of only one eye loop portion.

As a further alternate embodiment, referring now to FIG. 7, it is envisioned that a single eye loop version of the "no-tie" net attaching member 20', comprised of a region 22' corresponding to the central region of the principal embodiment, and an eye loop 24' and extremity 28', would serve equally as a less expensive embodiment.

While the present invention has been hereinabove described and illustrated in its principal embodiment and in several alternate embodiments, all referring primarily to the application as a basketball goal assembly, it should be understood that the invention is not limited to the precise details herein illustrated and described since the same may be carried out in other ways falling within the scope of the invention as claimed below.

I claim:

1. A sports goal assembly, comprised of a goal frame member, supporting means, a goal net, and a plurality of "no-tie" net attaching members spaced about the extent of said goal frame member, each of said net attaching members accepting one of an equal plurality of cord loops formed on the periphery of the said goal net, each of said net attaching members being configured so as to be rigidly attached to said goal frame member at its central region, and with each said net attaching member containing a partial eye loop region, depending from the surface of said goal frame member, unitarily formed at each end of said central region, said partial eye loop regions closing toward but not upon said central region, with the extremities of the material forming the said net attaching member assuming tension contact with said goal frame member such that said cord loop may be passed from the exterior to the interior of said eye loop regions, but such that the reverse passage of said cord loop is precluded.

2. The sports goal assembly of claim 1, wherein said net attaching member is formed of material having a circular cross-section of minimal dimension.

3. The sports goal assembly of claim 1, wherein said net attaching member is formed of a material having a rectangular cross-section.

4. The sports goal assembly of claim 1, wherein the said goal frame member contains flattened regions at the situs of each of the plurality of "no-tie" net attaching members, such that the maximum extension of each said "no-tie" net attaching member normal to said flattened surface does not exceed the nominal external dimension of said goal frame member.

5. A sports goal assembly, comprised of a goal frame member, supporting means, a goal net, and a plurality of "no-tie" net attaching members spaced about the extent of said goal frame member, each of said net attaching members configured to have an attaching region rigidly affixed to said goal frame member and a single partial eye loop region unitarily formed with said attaching region and depending therefrom normal to and away from the surface of said goal frame member, said partial eye loop region closing toward but not upon said attaching region, with the extremity of the material forming said net attaching member assuming tension contact with said goal frame member, such that a cord loop of an equal plurality of cord loops about the periphery of said goal net may pass between said extremity and said goal frame member from the exterior to the interior of said eye loop region but not in reverse.

* * * * *